US008087144B2

(12) United States Patent
Kain

(10) Patent No.: US 8,087,144 B2
(45) Date of Patent: Jan. 3, 2012

(54) METHOD AND APPARATUS FOR PROTECTING A SUBSTRATE

(76) Inventor: Don Kain, Lake Arrowhead, CA (US)

( * ) Notice: Subject to any disclaimer, the term of this patent is extended or adjusted under 35 U.S.C. 154(b) by 799 days.

(21) Appl. No.: 11/072,688

(22) Filed: Mar. 4, 2005

(65) Prior Publication Data

US 2008/0263994 A1 Oct. 30, 2008

Related U.S. Application Data

(63) Continuation of application No. 10/291,957, filed on Nov. 9, 2002, now Pat. No. 7,788,866.

(51) Int. Cl.
*B23P 19/04* (2006.01)

(52) U.S. Cl. ..... 29/460; 29/415; 156/92; 52/244; 52/300

(58) Field of Classification Search ..... 29/415, 29/417, 460; 52/244, 300, 301, 736.3, 738.1, 52/741.4, 741.3; 156/91, 92, 308.2, 308.4, 156/309.6

See application file for complete search history.

(56) References Cited

U.S. PATENT DOCUMENTS

| | | | | | |
|---|---|---|---|---|---|
| 725,820 | A | * | 4/1903 | Beazley | 52/170 |
| 1,095,197 | A | | 5/1914 | Entenmann | |
| 2,724,156 | A | * | 11/1955 | Shaw | 52/168 |
| 3,352,581 | A | * | 11/1967 | Robbins et al. | 403/244 |
| 3,914,863 | A | * | 10/1975 | Wiebe | 29/623 |
| 4,019,301 | A | | 4/1977 | Fox | |
| 5,315,796 | A | | 5/1994 | Gruhlke | |
| 5,625,988 | A | | 5/1997 | Killick | |
| 5,752,349 | A | | 5/1998 | Fitzsimmons et al. | |
| 5,901,525 | A | | 5/1999 | Doeringer et al. | |
| 6,041,559 | A | | 3/2000 | Schickert et al. | |
| 6,098,353 | A | | 8/2000 | Stanfield | |
| 6,231,994 | B1 | | 5/2001 | Totten | |
| D451,614 | S | | 12/2001 | Merrick | |
| 6,336,620 | B1 | | 1/2002 | Belli | |
| 6,389,760 | B1 | | 5/2002 | McDonnell | |
| D460,570 | S | | 7/2002 | Grant | |

(Continued)

OTHER PUBLICATIONS

U.S. Appl. No. 10/291,957, filed Nov. 9, 2002, Don Kain, 2004-0088934, Apr. 21, 2008 Final Office Action, Dec. 9, 2005 Office Action, Oct. 1, 2004 Restriction Requirement.

(Continued)

*Primary Examiner* — David Bryant
*Assistant Examiner* — Christopher Koehler
(74) *Attorney, Agent, or Firm* — Knobbe, Martens, Olson & Bear, LLP

(57) ABSTRACT

A method and apparatus for capping and encapsulating a shaped wooden workpiece or substrate to protect against environmental elements and prevent splintering of the wooden substrate in the installed condition is disclosed. An inventive end cap having a melt ring integrally formed therewith is installed on a portion of the substrate, such as a terminus of the substrate. According to the invention, the wooden substrate is sheathed during a polymeric extrusion process with a substantially continuous, unbroken polyethylene or other polymeric layer extending from and continuous with the inventive end cap. During the extrusion process, the melt ring integrally formed along the annular walls of the end cap melt the encapsulant and form a substantially sealed configuration with the polymeric layer applied to the substrate. The melt ring is engineered to sealingly incorporate with the polymeric extrusion as the molten encapsulant is applied to the wooden substrate, to provide a substantially uniform sealed joint between the end cap and the polymeric layer while maintaining a substantially uniform cross-section along the length of the wooden substrate following completion of the encapsulation process.

15 Claims, 5 Drawing Sheets

U.S. PATENT DOCUMENTS

| | | | | |
|---|---|---|---|---|
| 6,691,479 | B1 | 2/2004 | Tscharner | |
| 6,789,368 | B2 | 9/2004 | Savenok | |
| 6,804,921 | B2 | 10/2004 | Neylon | |
| 6,848,663 | B2 * | 2/2005 | Olive | 248/317 |
| 6,851,838 | B2 | 2/2005 | Haddad et al. | |
| 6,857,235 | B2 | 2/2005 | Niday et al. | |
| 6,886,296 | B1 | 5/2005 | John et al. | |
| 7,003,919 | B2 | 2/2006 | Riker | |
| 7,150,579 | B2 | 12/2006 | Newton | |
| 2002/0062545 | A1 * | 5/2002 | Niedermair | 29/417 |

OTHER PUBLICATIONS

U.S. Appl. No. 10/291,957, filed Nov. 9, 2002, Don Kain, 2004-0088934, Mar. 6, 2009 Office Action, Apr. 21, 2008 Final Office Action, Dec. 9, 2005 Office Action, Oct. 1, 2004 Restriction Requirement.

* cited by examiner

METHOD AND APPARATUS FOR PROTECTING A SUBSTRATE

CROSS-REFERENCE TO RELATED APPLICATIONS

This is a continuation of application Ser. No. 10/291,957, filed Nov. 9, 2002 now U.S. Pat. No. 7,788,866.

STATEMENT RE: FEDERALLY SPONSORED RESEARCH/DEVELOPMENT:

Not applicable.

BACKGROUND OF THE INVENTION

1. Field of the Invention

This invention relates generally to the field of protective coatings for use with structural members and more particularly to encapsulation of portions or the entirety of structural members utilized in structures for outdoor use including playground equipment.

2. Description of the Related Art

The use of wood-based columns and beams as structural supports for outdoor equipment including playground equipment and the like is well known. The usual materials of construction for such outdoor structures are wood or a combination or composite of wood or other materials. Playground equipment constructed with wood and wood product structural members and accessories are necessarily located in outdoor and environmentally hostile environments, subjected not only to wide variations in humidity but also ground moisture, wide-ranging variations in temperature, as well as exposure to vermin, pests, animals and their by-products, as well as chaffing and impact caused by use of that equipment or maintenance and gardening equipment used in the immediate area. Such structural materials may also be damaged or subject to deterioration by salt water, corrosive pollution, cycles of wetting and drying, cycles of freezing and thawing and electrolysis in coastal or marine environments. Thus, erosion, marine organisms, mechanical impact, water content and abrasion may also cause premature wear and failures of even properly designed structures. Moreover, incomplete protection of the wooden structural member will allow moisture to seep into the structural member or fasteners connected therethrough, causing the fastener to rust or corrode and allowing mildew to form around the fastener. Moisture also causes galvanic action between dissimilar metals such as support brackets and fasteners often used in outdoor equipment which leads to corrosion. In turn, such deterioration will compromise the structural integrity of surrounding and supporting materials, including the wooden substrate.

Protecting wood-based supports, columns or other load supporting structural members used in such hostile environments is often times unreliable and inconsistent in the desired protective effects. Some known alternatives or methods for minimizing or arresting deterioration include pressurized, chemically-impregnated wood treatments, and protective coatings include vinyl wraps. However, those approaches have been known to provide inconsistent results. Furthermore, such means of repair or protection are only short term solutions and may be unfeasible for certain structures. For instance, pressure treated wooden products are susceptible to uneven processing and furthermore do not overcome the problem of splintering which is of significant importance for playground equipment, and vinyl wraps are subject to puncture and tearing from mechanical impact and heretofore have not satisfactorily addressed problems of moisture seepage at the ends and feet of components to be positioned adjacent to surface level. In addition, most protective coatings eventually fail due to inadequate surface preparation, improper application, ultra violet light exposure, mechanical wear or pinhole defects.

A known repair and protective procedure for damaged, as well as new structures for use with outdoor and corrosive environments provides for encapsulation in a corrosion resistant polymer jacket. By pouring a flowable mixed epoxy material into a surrounding form or jacket, the epoxy grout would solidify or harden about the structural component, thus providing a good seal against environmental antagonists, and also sealing off oxygen incursion to thereby prevent deterioration of the wooden structure.

An example of a protective and repair encapsulation technique is provided in U.S. Pat. No. 4,019,301 issued to Fox. While an improvement over prior practice, the Fox method can often be unreliable. By simply pouring the batch mixed epoxy encapsulating material into the surrounding form, no assurance is obtained that gravity flow will effect elimination of voids or seams by completely filling the surrounding form or that premature set up of the encapsulating material will not channel the filling material flow. Through the process of pouring the epoxy into the submerged fiberglass jacket or form, water can dilute, entrain or mix with the epoxy, thus adversely affecting the engineering properties of the protective or repair system. The pouring procedure also can create holidays or non-bonded cold joints between pours, be very time consuming, messy and impractical for structures that are not readily accessible. Furthermore, no provision was made for verifying, by visual observation or otherwise, that the encapsulating material fully filled the jacket form or for field verifying that adequate structural bonding to the structure has occurred.

In addition, it is well known that wood and wood products are susceptible to wood destroying organisms such as insects and fungi, as well as to moisture when exposed to rain, snow or substantial amounts of ambient moisture. Even when such wood and wood products are treated with preservatives such as borates and other water soluble infection controlling compositions, effective usefulness is limited because such water soluble compositions leach out of the wood, leaving it exposed to infection. Treated wood, for example, could not be left exposed to the elements in use, storage or shipment. Thus, wood could not be treated at a central location, transported to and stored in the open at a construction site.

Heretofore, conventional methods for protecting such wood and wood-based playground equipment have included pressure treatment of the timbers and connecting members from which that equipment is constructed. It is also known, and commonly recommended, to support the lower portions of the playground equipment at or several inches above ground level using a concrete pad or the like in an effort to isolate the lower portion of the wood structural member from ground moisture, ponding, and constant attack by ground-based insect and animal exposure. Also, it is known to coat such timbers and connecting members in a polymeric sheathing (as noted above) in an effort to provide an inert barrier against moisture, insects and other elements deleterious to long-term structural integrity of the structure. One prior art approach was to provide a polymeric sheathing along the longitudinal faces of the timbers, followed by the attachment of end caps. Heretofore, such efforts have exhibited important shortcomings as described, and in the instance of the prior art end caps, those articles typically include edges that are not sealed against the timbers to which they are fitted, thereby enabling the ingress of moisture and other elements in the manner described.

Accordingly, there is a need for a protective, all-encompassing coating for outdoor structures such as playground equipment subjected to harsh environmental elements and physical contact that overcomes the problem of splintering common to pressure-treated but unsheathed wooden structural members while protecting against agents that cause deterioration and premature deterioration of those structural components.

SUMMARY OF THE INVENTION

The present invention is a method and apparatus for encapsulating by use of an extrusion process a shaped wooden workpiece or substrate to protect against environmental elements and prevent splintering of the wooden substrate in the installed condition. According to the invention, the extrusion process sheaths the wooden substrate with a substantially continuous, unbroken polyethylene or other polymeric layer extending from and continuous with an inventive end cap. The end cap according to the several embodiments incorporates a melt ring integrally formed therewith for melting with and forming a substantially sealed configuration with the polymeric layer applied thereto, thereby overcoming a prior art shortcoming of gaps and insufficient sealing adjacent to the ends of the wooden substrate. The melt ring is engineered to sealingly incorporate with the polymeric extrusion as the molten encapsulant is applied to the wooden substrate, to provide a substantially uniform sealed joint between the end cap and the polymeric layer while maintaining a substantially uniform cross-section along the length of the wooden substrate following completion of the encapsulation process.

It will be appreciated that the method and apparatus of the present invention is applicable to encapsulation of structural materials other than wooden substrates, and may be used as an effective substitute for other finishes and protective layers known in the art. It will be further appreciated that the method and apparatus of the present invention is applicable to use with structural members of all types, including but not limited to utility and telephone poles (typically protected with creosote or other noxious materials), metallic and non-metallic traffic signal and sign support poles, structural members incorporated in the construction of piers and other structures designated for marine environments, indoor and outdoor furniture subject to corrosion or impact-prone usage, sports equipment poles (basketball poles), and the like.

According to the invention, during the encapsulation process, one or a plurality of wooden substrates are serially fed through an encapsulation process line via a conveyor system, and adjacent substrates preliminarily fitted with the inventive end cap are sheathed with the molten encapsulant. More particularly, the invention includes a method of forming a protective encasement about at least a portion of a structural member having a terminus including a base surface and at least one lateral surface extending therefrom, providing a terminus mounting cap (or end cap, although it is contemplated that the cap may be applied at an intermediate portion of a structural member to encapsulate a structural feature at that intermediate extent) having a base portion supporting a wall extending therefrom, the wall including a meltable portion.

According to the invention, the terminus mounting cap is positioned immediately adjacent to the base surface to position the meltable portion adjacent at least one lateral surface, and a molten jacket of polymeric material is applied about the cap and a contiguous portion of the structural member adjacent to the terminus to cause the meltable portion to melt and substantially bond to the lateral surface and encapsulate the cap about the terminus and the immediately adjacent contiguous structural member portion. To further secure and encapsulate the designated region of the structure member, a substantially contiguous connection of the plurality of walls is provided in an annular arrangement extending from the base portion, a melt ring is provided about the interior of the annular wall arrangement, and the molten encapsulating jacket is provided over the region extending at least from the base portion to the melt ring to substantially bond the melt ring and fully encapsulate the so-defined region.

The end cap of the present invention is thus provided for encapsulating a portion of a structural member having a terminus and a plurality of lateral faces extending from the terminus, the end cap including a base portion for engaging the terminus of the structural member, a plurality of wall portions extending orthogonally from a face of the base portion of the terminus mounting cap in an open annular arrangement, and a melt ring integrally formed in the annular arrangement of the wall portions for substantially continuous adhesion about the contiguous lateral faces of the structural member upon application of a molten jacket of polymeric material to the installed combination of the end cap and terminus. The base portion of the end cap includes an interior planar surface orthogonal to the wall portion for engaging with a corresponding planar face of the terminus of the structural member, and may further include a textured surface integrally formed therewith for receiving an adhesive material co-compatible with the terminus and the end cap. Additionally, the melt ring may be provided at an intermediate height of the wall portions, or immediately adjacent the base portion. As described, during the encapsulation process, the melt ring or melt portion provided on one or more walls of the end cap melts with and bonds with the encapsulant to encapsulate the structural member at the designated region as desired.

It should be noted and understood that with respect to the embodiments of the present invention disclosed herein, the materials, methods, apparatus and processes disclosed and suggested may be modified or substituted to achieve the desired protected structures without departing from the scope and spirit of the disclosed and claimed invention.

BRIEF DESCRIPTION OF THE DRAWINGS

FIG. 8(*b*) is an elevational view of the protective cap of yet a further embodiment of the present invention.

DETAILED DESCRIPTION OF THE PREFERRED EMBODIMENTS

Figure 1:
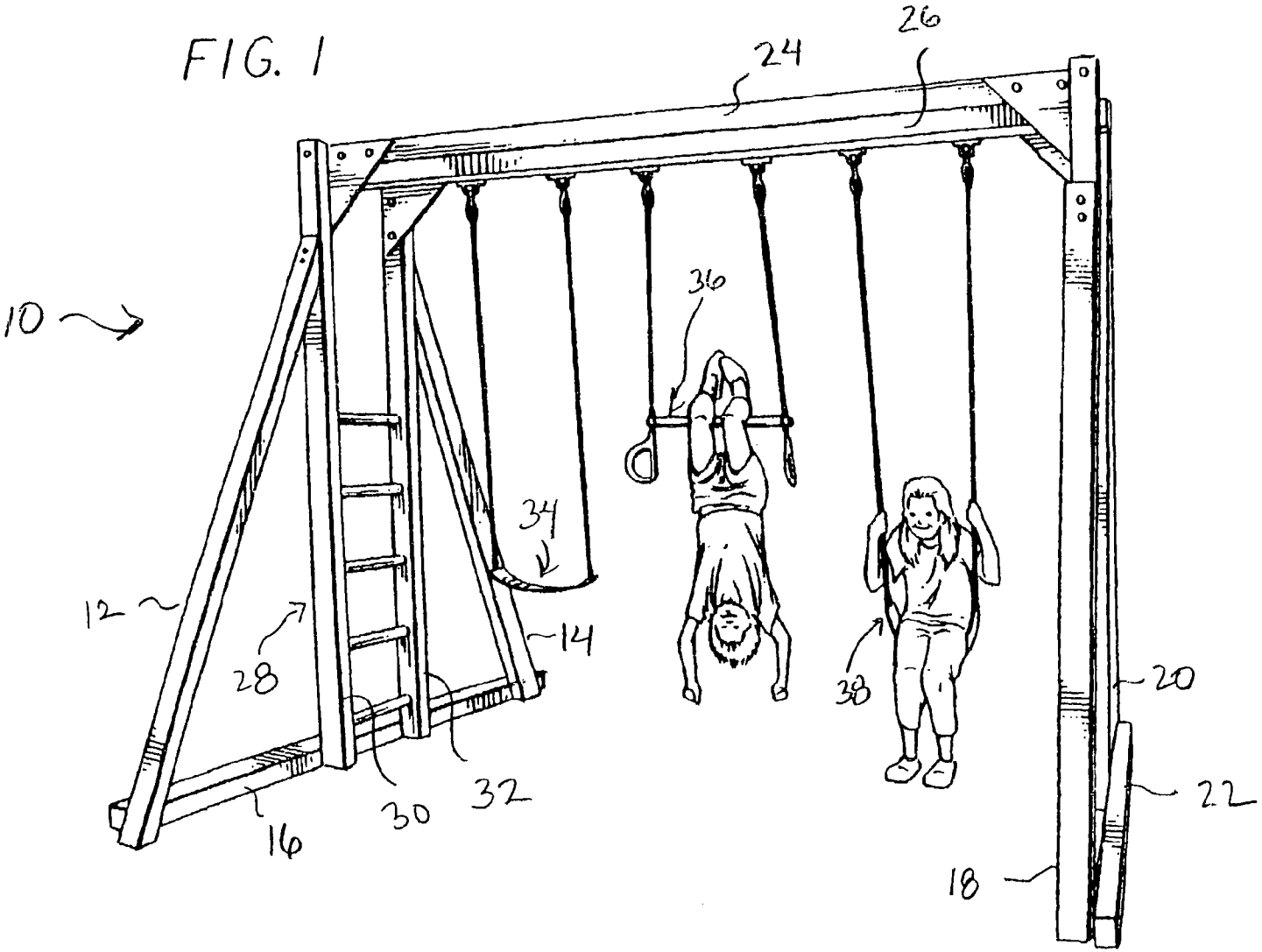
FIG. 1 is a perspective view of a playground set incorporating a plurality of wooden substrate members assembled and secured to support a variety of playground activities, the wooden substrate members processed by and incorporating the encapsulation method and apparatus of the present invention.

Referring now to the drawings wherein like numerals designate like and corresponding parts throughout the several views, FIG. 1 shows a perspective view of a playground set 10 incorporating a plurality of encapsulated members 12, 14, 16, 18, 20, 22, 24, 26, 30, 32 (hereinafter referred to as encapsulated member 12) for either supporting the overall structure, or providing additional support for a substructure such as ladder 28 having side rails 30, 32, or swings 34, 36, 38, each encapsulated member 12 being assembled and encapsulated according to the present invention.

Figure 2:
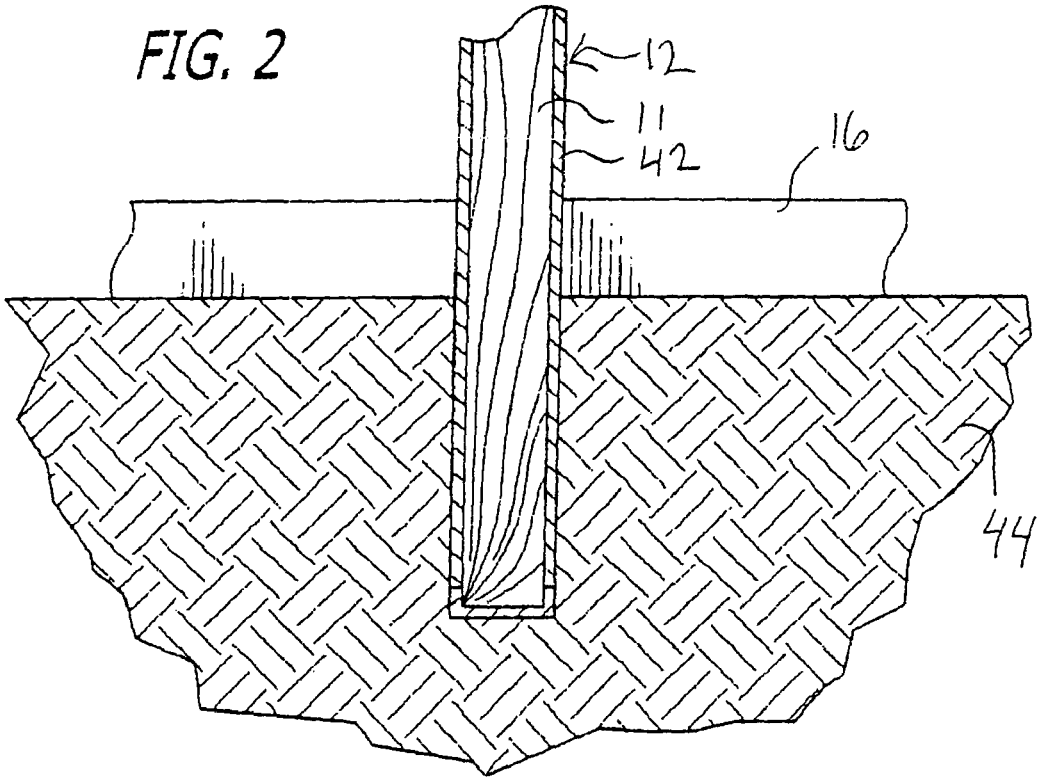
FIG. 2 is a cross-sectional view of a lower extent of a wooden substrate member, such as a vertical post member of the integrated ladder and playground set shown in FIG. 1, installed in an in situ environment, partially implanted in an earthen environment common to many playground environments.
Figure 3:
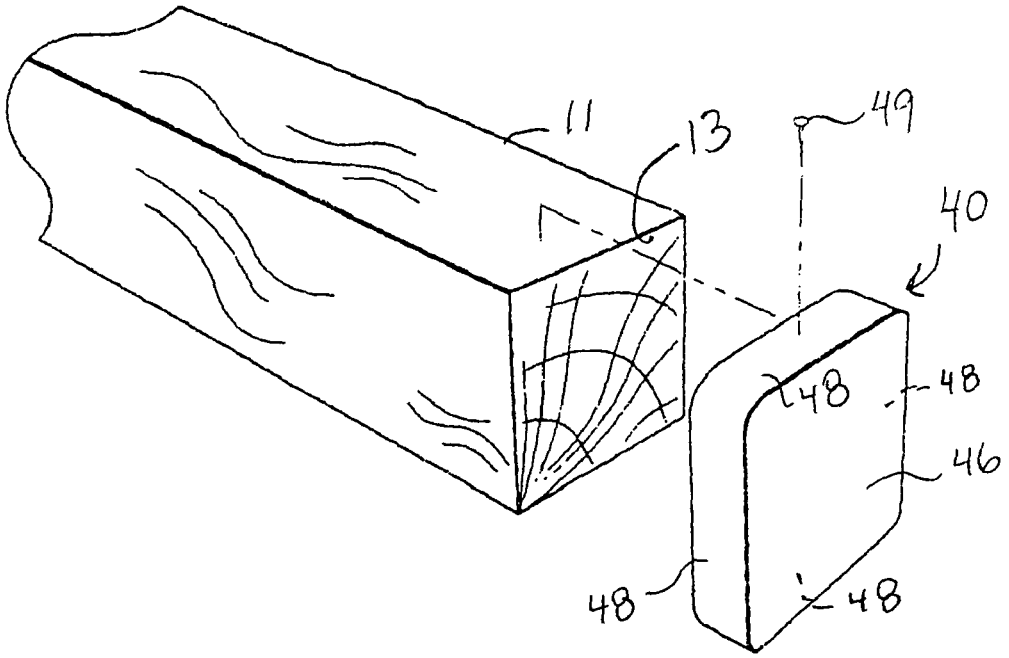
FIG. 3 is an exploded view of a protective cap of the present invention to be installed about the end of a wooden substrate with a preliminary pinned or nailed connection prior to subsequent steps of the encapsulation method of the present invention.

Referring now to FIGS. 2 and 3, each exemplary encapsulated member 12 includes a wooden substrate 11 having a terminus 13 to which the inventive end cap 40 of the present invention has been installed, and subsequently encapsulated in a jacket of polymeric material 42 that has been applied to and about the end cap 40 and a contiguous portion of the structural member 11 adjacent to the terminus of the substrate 11 according to the method to be more fully described below. As will be appreciated by the skilled artisan, the jacket 42 is applied over a sufficient linear extent of the substrate 11 to isolate it from direct contact with supporting media such as soil, gravel or concrete 44 in which it is implanted. Also as will be more fully described, the method of the present invention provides for encapsulating the entire length of the substrate in the jacket 42, thereby enabling the installation of the encapsulated member to any depth or even to be laid directly on an environmental surface, as shown by encapsulated member 16, while providing all of the benefits of the method and apparatus of the invention.

With reference now to FIGS. 3-7, and according to the preferred embodiment of the present invention, end cap 40 is provided with a base portion 46 having one or more walls 48 extending orthogonally therefrom. According to one preferred embodiment of the present invention, four contiguously formed walls 48 extend orthogonally from the base portion 46 of the terminus mounting cap, and embrace corresponding lateral walls of substrate 11 orthogonal to its terminus 13. Also preliminary to the encapsulation process, a fastener such as a nail 49 is driven through a wall 48 to temporarily secure the end cap 40 to the substrate 11 and snugly retain the end cap 40 against the terminus 13 during the encapsulation process.

According to an important aspect of the invention, a melt ring 100 is integrally formed as an annular structure about the outer extent of the walls 48, coextensive with the outer structure of base portion 46. Although shown at the conjunction of the base portion 46 and walls 48, and according to another embodiment, the melt ring 100 may be provided at an intermediate extent (height) of the walls 48 to enclose a lesser or greater volume of the substrate 11 relative to its terminus 13. The melt ring 100 may be sized and shaped as necessary to meet melt/solidification specifications during the encapsulation process, i.e., to sufficiently melt as required and bond with the liquid encapsulation jacket applied thereto. To achieve that goal, end cap 40 and melt ring 100 is fabricated of a polymeric composition engineered to have a solidification temperature compatible with that of the encapsulating material of the jacket 42 to be applied thereto to enable a coordinated melt and complete encapsulation between the melt ring 100 and the encapsulating jacket. It is contemplated that a composite structure may be provided according to another embodiment of the invention, wherein the melt ring 100 has a solidification temperature different from that of the remainder of the end cap to produce alternative melt/bond characteristics.

Alternatively, the melt ring may be separately fabricated and assembled to a selected longitudinal extent of the substrate 11 to function in concert with the end cap used therewith, the solidification temperatures of the melt ring 100 and end cap 40 being the same or different as required by a particular application. As an integral component, wall 48 is also sized and shaped as necessary to meet melt/solidification specifications during the encapsulation process, i.e., to sufficiently melt as required and bond with the liquid encapsulation jacket applied thereto. Such solidification temperature is about 325 degrees F. or greater for a polyvinyl chloride (PVC) or polyolefin plastomers such as those provided by Dow Plastic, Inc., Midland, Mich., for construction of the end cap 40 and/or melt ring 100, with exothermic bonding providing additional encapsulation properties as the thermoplastic jacket is cooled to room temperature during the extrusion process. In any case, and to address an important shortcoming in the prior art, the nail 49 is inserted at the distal end of the end cap 40 at a longitudinal extent of the substrate 11 opposite the base 46 separated by the melt ring 100 to eliminate the intrusion of moisture and other undesirable elements into the cap and melt ring-extrusion region. The encapsulation method and apparatus of the present invention may additionally be practiced in accordance with U.S. Pat. No. 6,231,994 issued in the name of Totten, the teachings of which are fully incorporated herein by reference.

End cap 40 includes base portion 46 supporting four walls 48 upstanding therefrom to define a concavity 50 surrounded by a shoulder 52 that abuts the terminus 13 of substrate 11 in the fully installed condition. The cavity 50 is segmented into four chambers 50(*a*), 50(*b*), 50(*c*), 50(*c*) by a pair of upstanding ribs 54 extending from base portion 46 between each pair of opposing corners and intersecting at a central standoff 56 that further supports the end cap 40 against the terminus 13 in the fully installed condition. A peripheral groove 58 is integrally formed in the base portion 46 opposite the walls 48 to provide an annular channel opening to the opposite face of the base portion 46.

Figure 5:
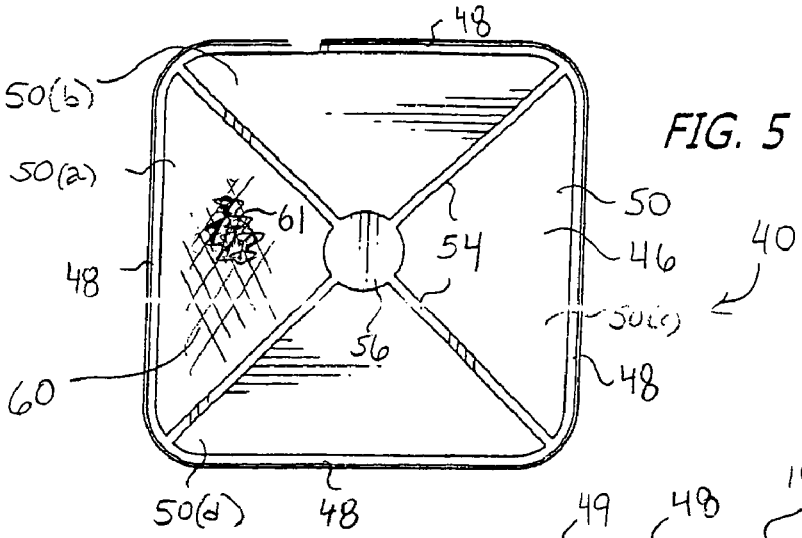
FIG. 5 is an elevational view of the protective cap of the present invention shown in FIG. 3.
Figure 6:
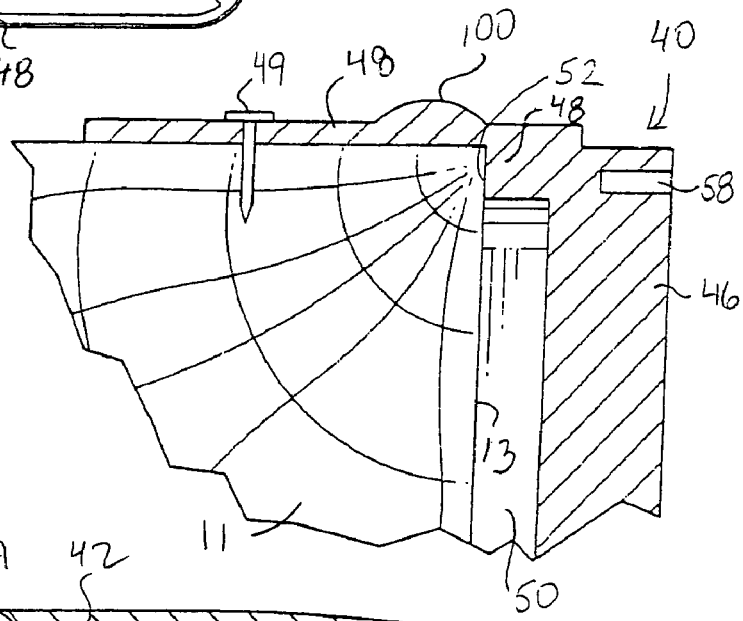
FIG. 6 is a partial elevational view of the protective cap installed at the terminus of a wooden substrate, shown preliminarily secured thereto with a fastener prior to the encapsulation process.
Figure 7:
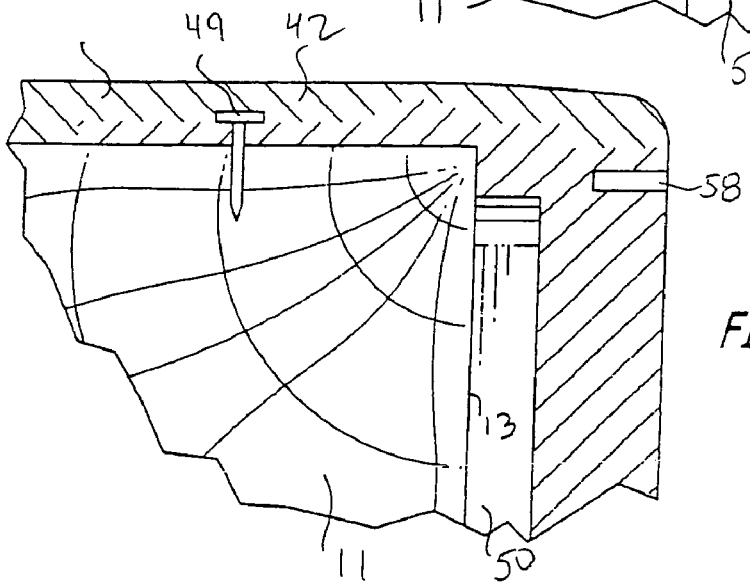
FIG. 7 is a partial elevational view of the protective cap installed at the terminus of a wooden substrate, shown subsequent to the encapsulation process, a melt ring provided in the outer lip of the cap being fully encapsulated within the extruded melted polymeric sheath provided according to the encapsulation processing method of the invention.

The base portion 46 of the end cap 40 may optionally includes a textured surface shown by cross-hatching 60 in FIG. 5, for receiving an adhesive material 61 co-compatible with the terminus and the end cap 40 to assist in preliminarily adhering the end cap 40 to the terminus 13.

Figure 8A:
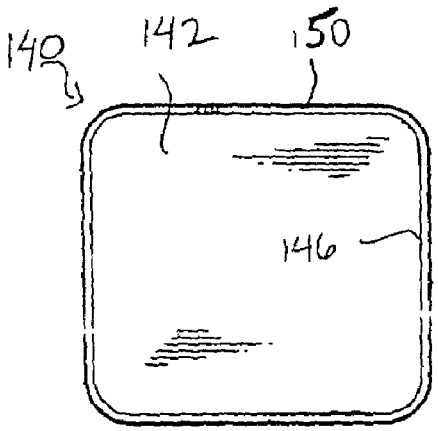
FIG. 8(*a*) is an elevational view of the protective cap of another embodiment of the present invention.
Figure 8B:
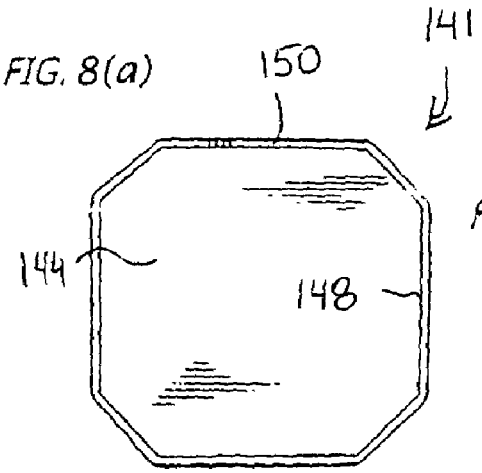
Figure 9:
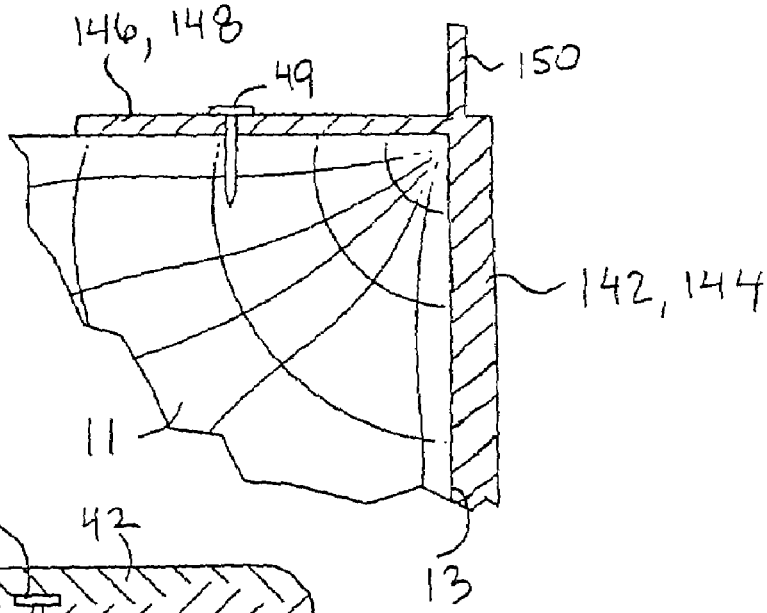
FIG. 9 is a partial elevational view of the protective cap of the embodiment shown in FIG. 8 installed at the terminus of a wooden substrate, preliminarily secured thereto with a fastener prior to the encapsulation process.
Figure 10:
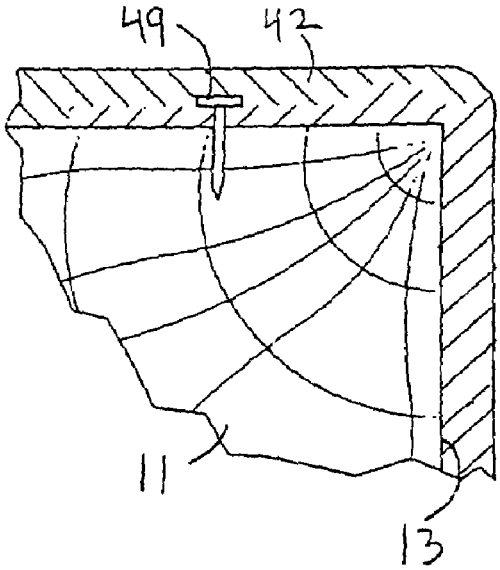
FIG. 10 is a partial elevational view of the protective cap of the embodiment shown in FIG. 8 installed at the terminus of a wooden substrate, subsequent to the encapsulation process, a melt ring being fully encapsulated within the extruded melted polymeric sheath provided according to the encapsulation processing method of the invention.

With reference now to FIGS. 8-10, and according to another embodiment of the present invention, end caps 140, 141 having a substantially square base portion 142 (FIG. 8(*a*)) or a polygonal base portion 144 (FIG. 8(*b*)), respectively, further include a circumferential wall 146, 148, respectively, extending orthogonally therefrom. Specifically, the circumferential walls 146, 148 extend orthogonally from the base portions 142, 144 of the selected end cap 140, 141, and embrace corresponding lateral walls of substrate 11 orthogonal to its terminus 13 in the manner previously described when the base portion 142, 144 is positioned either adjacent to or in substantial contact with the opposing terminus 13, and in that selected position is secured with a fastener such as nail 49 driven through wall 146, 148 to temporarily secure the end cap 140, 141 to the substrate 11 and snugly retain the end cap 140, 141 against the terminus 13 during the encapsulation process.

Also according to an important aspect of the invention, a melt ring 150 is integrally formed as an annular structure about the outer extent of the walls 146, 148, coextensive with the outer structure of base portions 142, 144. Although shown at the conjunction of base portion 142, 144 and walls 146, 148, and according to yet another embodiment, the melt ring 150 may be provided at an intermediate extent (height) of the walls 146, 148 to extend laterally from the base portions 142, 144 or the walls 146, 158. Furthermore, the melt ring 150 may be sized and shaped as necessary to meet melt/solidification specifications during the encapsulation process, i.e., to sufficiently melt as required and bond with the liquid encapsulation jacket applied thereto in the manner previously described. As with the first described embodiment, walls 146, 148 may be sized and shaped as necessary to meet melt/solidification specifications during the encapsulation process, i.e., to sufficiently melt as required and bond with the liquid encapsulation jacket applied thereto.

Figure 4:
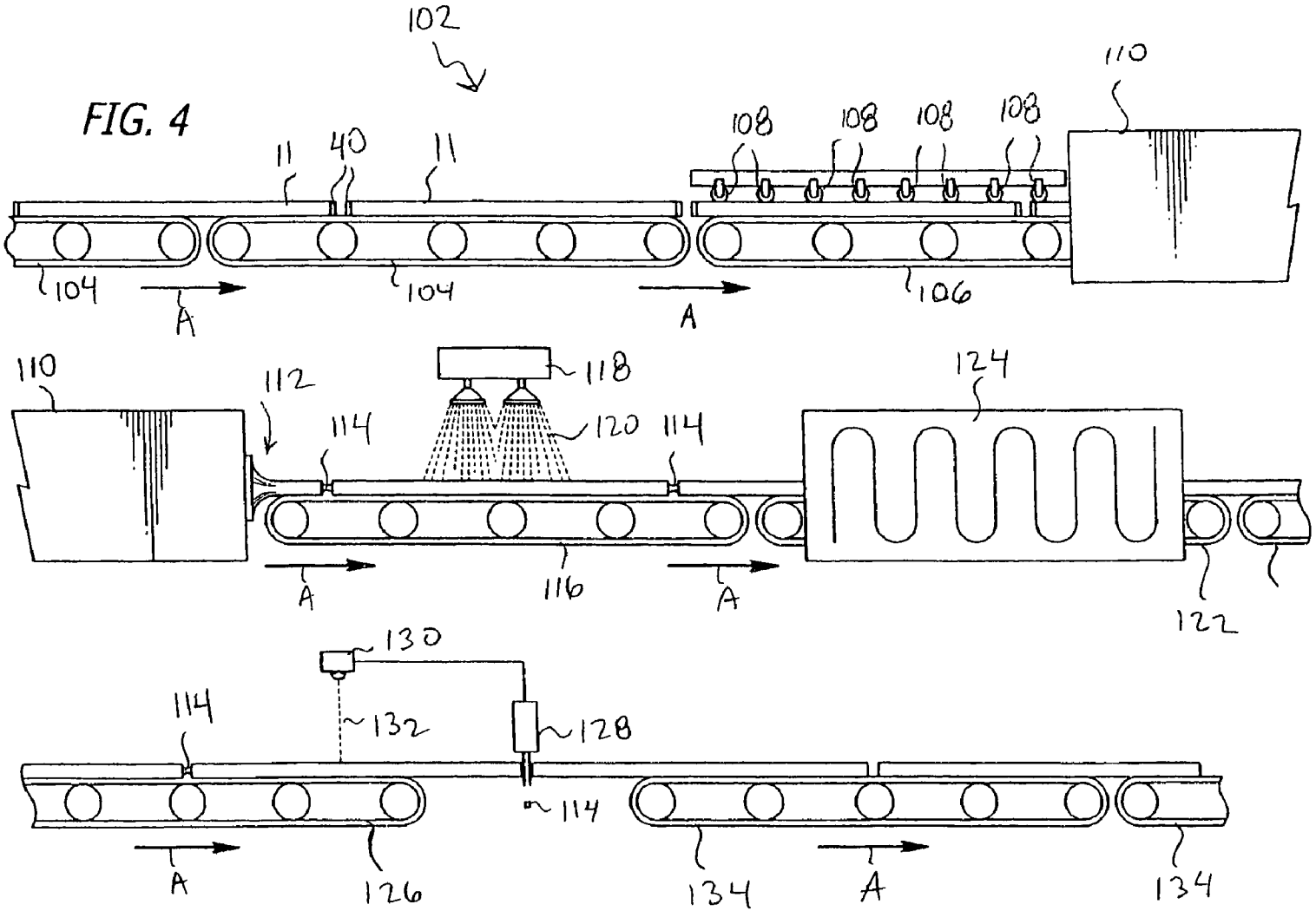
FIG. 4 is a schematic side elevational view of the processing system of the encapsulation method of the present invention, showing various processing stations for sequentially delivering and processing the substrates to be capped and encapsulated according to the invention.

With specific reference now to FIG. 4, the encapsulation method of the invention is schematically represented. Encapsulation system 102 includes conveyor line 104 for initially receiving, supporting and conveying substrates 11 in series in the direction of arrow A, after the substrates 11 placed on conveyor line 104 have preliminarily received end caps 40 that have been secured with fastener 49 and/or adhesive 61 deposited on the textured surface 60 provided in the cavity 50 of base portion 46. The substrates 11 are then serially fed into conveyor line 106 and through a plurality of pressure feed rollers 108 to coaxially align the substrates 11 and further position opposing end caps 40 in close juxtaposition, preferably maintaining a separation of about 3 inches therebetween, although it will be apparent to the skilled artisan to adjust the pressure feed rollers 108 to achieve a narrower or broader separation depending on the dimensions and type of substrate encapsulated by the system 102. While supported in this position, the constrained substrates 11 are further fed though an encapsulation station 110, and which then receive a molten encapsulating jacket at extrusion outlet 112. The resulting encapsulated substrate 11 and connecting slug 114 of the encapsulant are fed into cooling station conveyor line 116, which supports a water coolant spray system 118 for discharging a preliminary uniform, cooling spray 120. It will be appreciated that during the encapsulation process and during the cooling stages of the process, melt ring 100, 150 and thinner wall portions 48, and 146, 148 will melt and bond as necessary to form the fully encapsulated structures shown in FIGS. 7 and 10, whereby the melt rings 100, 150, respectively, are fully bonded with the encapsulating jacket 42.

Again referring to FIG. 4, the conjoined substrates 11 are further fed into cooling station conveyor line 122, which supports cooling apparatus 124 such as a water bath for reducing the encapsulation jacket temperature below the PVC melt temperature (350 degrees F.), and preferably down to at least 325 degrees F. The still-conjoined substrates are further fed into a slug cutting station conveyor line 126, whereupon the encapsulated substrates are separated from connecting slug 114 by a cutting knife 128. The cutting knife may be operated manually, or alternatively, by a sensor system 130 utilizing an optical detection system having feedback circuitry based upon the return of an optical beam 132. According to either embodiment, the connecting slug 114 is severed close to and parallel with the bottom surface of encapsulated terminus 13 of the resulting encapsulated member 12, which is supported by and conveyed to a stock receiving bin by finish conveyor line 134.

It is to be understood that the present invention is not limited to the embodiments described above, but encompasses any and all embodiments within the scope of the following claims.

What I claim is:

1. A method of forming a protective encasement about at least a portion of a structural member having a terminus including a base surface and at least one lateral surface extending therefrom, comprising:

providing a terminus mounting cap having a base portion supporting a wall extending perpendicularly therefrom, wherein the wall and base portion define a receptacle and wherein the wall includes a meltable portion that is formed so as to extend outward from the wall and so as to be spaced along the wall from the base portion so that a portion of the wall is interposed between the meltable portion and the base portion;

positioning the cap immediately adjacent to the base surface so that the portion of the structural member having the terminus is positioned within the receptacle and to position the meltable portion adjacent the at least one lateral surface; and providing a molten jacket of polymeric material about the cap and a contiguous portion of the structural member adjacent to the terminus to cause the meltable portion to melt and substantially bond to the at least one lateral surface and encapsulate the cap about the terminus and the immediately adjacent contiguous structural member portion wherein the molten jacket of polymeric material is adhered to the portion of the wall of the terminus mounting cap that is interposed between the meltable portion and the base portion.

2. The method as recited in claim 1, further comprising:

positioning the wall in substantially immediate contact with the corresponding opposing lateral face of the structural member.

3. The method as recited in claim 1, further comprising:

providing a plurality of walls extending orthogonally from one face of the base portion of the terminus mounting cap; and positioning the walls in substantially immediate contact with a corresponding number of opposing lateral faces of the structural member.

4. The method as recited in claim 3, further comprising:

providing a substantially contiguous connection of the plurality of walls in an annular arrangement extending from the base portion;

providing a melt ring about the exterior of the annular wall arrangement; and providing the molten jacket over the rejoin extending at least from the base portion to the melt ring to substantially bond the melt ring and fully encapsulate the so-defined region.

5. The method as recited in claim 4, further comprising:

providing a melt ring formed of the substantial entirety of the annular arrangement of the walls.

6. The method as recited in claim 1, further comprising:

preliminarily securing the cap to the structural member with a fastener projected through and secured thereto at a lateral wall position separated from the base portion by the melt ring.

7. The method as recited in claim 1, further comprising:

providing the cap with a wall thickness in the range of about 0.0010-0.0020 inches.

8. The method as recited in claim 1, further comprising:

providing the cap with a wall thickness in the range of about 0.0012-0.0015 inches.

9. The method as recited in claim 1, further comprising:

providing a base thickness of about 0.0090 inches.

10. A method of forming a protective encasement about a plurality of structural members in a continuous encapsulation process each structural member having a longitudinal axis and at least one terminus including a base surface and a plurality of lateral surfaces extending therefrom, comprising:

providing a mounting cap to the at least one terminus of a first of said plurality of structural members, the mounting cap having a base portion with an inner surface and an outer surface, the mounting cap supporting a wall extending orthogonally therefrom, wherein the base portion and the wall define a receptacle so that the terminus is positioned within the receptacle, the wall including a meltable portion that is formed so as to extend outward from the wall and so as to be spaced along the wall from the base portion so that a portion of the wall is interposed between the meltable portion and the base portion and positioning the cap immediately adjacent to the base surface to position the meltable portion adjacent to the at least one lateral surface;

providing a mounting cap to a terminus of a second structural member;

positioning the second structural member adjacent to the first structural member, with the capped termini of the structural members supported in coaxial but opposing relationship;

providing a molten jacket of polymeric material along a length of the structural members and about the capped termini of the structural members to cause the meltable portion of each cap to melt and so that the molten jacket adheres the portion of the wall of the first member that is interposed between the base member and the meltable portion and substantially bond and encapsulate its respective terminus and cap and immediately adjacent contiguous structural member portion; and severing the conjoined structure members therebetween.

11. The method as recited in claim 10, further comprising:

severing the conjoined structural members coplanar with and substantially flush with the outer surface of each cap.

12. The method as recited in claim 10, further comprising:

providing for each cap a substantially contiguous connection of the plurality of walls in an annular arrangement extending from the base portion and defining a melt ring thereby; and providing the molten jacket at least about the melt ring to substantially bond the melt ring wall section about all of the corresponding lateral faces of the structural member and thereby substantially encapsulating the cap about the terminus and the contiguous structural member portion.

13. The method as recited in claim 12, further comprising:

providing a melt ring formed of the substantial entirety of the annular arrangement of the walls.

14. The method as recited in claim 10, further comprising:

preliminarily securing each cap to its respective terminus with a fastener projected through a flange extending from the wall above the melt ring.

15. The method as recited in claim 10, further comprising:

providing the inner surface of the mounting cap with a textured surface for receiving an adhesive to preliminarily secure the mounting cap to the base surface of the structural member.

* * * * *

UNITED STATES PATENT AND TRADEMARK OFFICE

CERTIFICATE OF CORRECTION

PATENT NO. : 8,087,144 B2
APPLICATION NO. : 11/072688
DATED : January 3, 2012
INVENTOR(S) : Don Kain It is certified that error appears in the above-identified patent and that said Letters Patent is hereby corrected as shown below:

In Column 9, Line 7, Claim 4, please change “rejoin” to --region--.

Signed and Sealed this
Eighteenth Day of September, 2012

David J. Kappos

David J. Kappos
*Director of the United States Patent and Trademark Office*